US009702173B2

(12) United States Patent
Wolf

(10) Patent No.: US 9,702,173 B2
(45) **Date of Patent: *Jul. 11, 2017**

(54) FER LOCKING SYSTEM FOR SLIDING WINDOWS

(71) Applicant: Truth Hardware Corporation, Owatonna, MN (US)

(72) Inventor: Glen M. Wolf, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/860,353

(22) Filed: Sep. 21, 2015

(65) Prior Publication Data

US 2016/0076282 A1 Mar. 17, 2016

Related U.S. Application Data

(63) Continuation of application No. 13/837,527, filed on Mar. 15, 2013, now Pat. No. 9,140,033.

(51) Int. Cl.

| | |
|---|---|
| ***E05C 3/14*** | (2006.01) |
| ***E05B 17/20*** | (2006.01) |
| ***E05C 3/04*** | (2006.01) |
| ***E05C 3/12*** | (2006.01) |
| *E05B 15/02* | (2006.01) |
| *E05B 17/00* | (2006.01) |
| *E05C 7/00* | (2006.01) |

(52) U.S. Cl.

CPC ..... *E05C 3/14* (2013.01); *E05B 17/2003* (2013.01); *E05C 3/046* (2013.01); *E05C 3/12* (2013.01); *E05B 15/0205* (2013.01); *E05B 17/0025* (2013.01); *E05C 2007/007* (2013.01); *Y10T 292/1041* (2015.04)

(58) Field of Classification Search

CPC ..... E05B 17/2003; E05C 3/00; E05C 3/002; E05C 3/004; E05C 3/046; E05C 3/12; E05C 3/14; E05C 3/145; E05C 19/10; E05C 19/12

See application file for complete search history.

(56) References Cited

U.S. PATENT DOCUMENTS

| | | | |
|---|---|---|---|
| 108,778 | A | 11/1870 | Gorman |
| 1,799,480 | A | 4/1931 | Rudder |

(Continued)

*Primary Examiner* — Katherine Mitchell
*Assistant Examiner* — Catherine A Kelly
(74) *Attorney, Agent, or Firm* — Patterson Thuente Pedersen P.A.

(57) ABSTRACT

A window lock assembly accomplishing FER manipulation protection against unintended window opening without using additional components in the typical FER lock assembly by using a passive barrier system to help prevent access to both the lock cam and lock lever handle. The device can include at least one lock assembly mounted on the interior side of the window's inner sash and having a locked and unlocked position. The lock assembly engages with at least one keeper mounted on the outer sash to secure the window. The lock assembly housing has a barrier extending outward from the bottom surface which effectively helps to block access to the cam. The lock assembly housing also has a shroud which extends from the top and side edges which partially or completely covers the keeper and effectively helps to block access to the lever handle.

5 Claims, 4 Drawing Sheets

(56) References Cited

U.S. PATENT DOCUMENTS

| | | | | |
|---|---|---|---|---|
| 1,900,936 | A | 3/1933 | Huttger | |
| 4,102,546 | A * | 7/1978 | Costello | E05B 17/2003 292/241 |
| 6,116,665 | A * | 9/2000 | Subliskey | E05B 17/2003 292/241 |
| 6,925,758 | B2 * | 8/2005 | Pettit | E05B 17/2003 292/346 |
| 7,000,957 | B2 | 2/2006 | Lawrence | |
| 8,567,830 | B2 | 10/2013 | Liang et al. | |
| 9,140,033 | B2 | 9/2015 | Wolf | |
| 2008/0169658 | A1 | 7/2008 | Wolf | |

* cited by examiner

FER LOCKING SYSTEM FOR SLIDING WINDOWS

RELATED APPLICATION

This application is a continuation of application Ser. No. 13/837,527 filed Mar. 15, 2013, said Application being hereby fully incorporated herein by reference.

FIELD OF THE INVENTION

The present invention relates to locking systems for windows, and more specifically to locking systems for sliding windows.

BACKGROUND OF THE INVENTION

Sliding window manufacturers typically use locking devices on the sash meeting rails to provide environmental control and security and to prevent unintentional opening of their windows. Typical locking devices help provide forced-entry resistance (FER) as a means to prevent unintended opening of the window.

Testing for forced-entry resistance (per ASTM F588) typically involves applying increasing opposing loads to the upper and lower sashes of the window in both horizontal and vertical directions and manipulating the window hardware for a specified period of time with simple hand tools such as a putty knife and/or a piece of stiff steel wire to try to gain access. Grading, which runs from 10 to 40, corresponds to increasing applied loads and manipulation times, with a minimum of grade 10 normally expected.

Failure of window hardware during the FER manipulation portion of testing typically occurs when the cam or lever handle is accessed and rotated to the unlocked position to allow unintended opening of the window. Typical locking devices use various means to help prevent FER manipulation of the lock's cam and lever handle. Some examples include; pick plates which extend under the bottom surface of the cam, shrouded keepers to help prevent access to the lock handle, stiff detents in the locked position, and locking "buttons" to help prevent the handle or cam from being rotated. One example of a prior sliding window lock device providing FER is disclosed in U.S. Patent Publication No. 2008/0169658 A1, owned by the owners of the present invention, and hereby fully incorporated herein by reference.

These methods generally work well independently or in combination with each other but typically add cost to the product due to the extra components required in the lock assembly to achieve FER manipulation protection. What is needed are improved lock devices and methods to prevent FER manipulation of the lock which do not require additional components (a passive FER system) compared to a non-FER lock assembly.

SUMMARY OF THE INVENTION

Embodiments of the invention accomplish FER manipulation protection against unintended window opening without using additional components in the typical FER lock assembly by using a passive "barrier" system to help prevent access to both the lock cam and lock lever handle.

The device can include at least one lock assembly adapted for mounting on the interior side of the window's inner sash with provision for a locked and unlocked position actuated by a rotating lever handle and transmitting rotation of the cam with the lever handle. The lock assembly engages with at least one keeper adapted for mounting in a window sash to secure the window in a closed and locked position. The lock assembly housing has a barrier extending outward from the bottom surface which effectively helps to block access to the cam from the normally exposed condition when in the locked position. The lock assembly housing also has a shroud which extends from the top and side edges which partially or completely covers the keeper and effectively helps to block access to the lever handle from the normally exposed condition when in the locked position.

The keeper is mounted on the interior side of the window's outer sash and is generally aligned with the lock assembly. The keeper generally has a boss feature which interfaces with the lock assembly's cam as the cam is rotated upon closure of the meeting window sashes and rotation of the lock's lever handle from the unlocked to the locked position. The keeper and lock horizontal placement causes the keeper's boss feature to create a slight horizontal movement of the window's inner sash toward the outer sash through the lock cam at lock-up. This movement creates an overlap of the lock housing lower barrier over a corresponding barrier on the keeper to effectively help block access the cam further. The keeper front face provides clearance for the lock's barrier feature when the lock is unlocked and the inner sash is lifted to help avoid interference from opening the window sash.

This locking has the ability to be adapted to work in a variety of window applications, and can be made of metal, polymer composite, or other suitable materials. The device can be used with vinyl, aluminum, wood, composite or other window materials.

In an embodiment, a lock assembly for a sliding window includes a sweep cam, a housing having a front wall, a pair of side walls, a top wall, and a rear wall together defining a cam housing recess. The sweep cam is rotatably received in the cam housing recess. The rear wall of the housing defines an opening with a barrier portion extending rearwardly from the rear wall under the opening. The sweep cam presents an upwardly projecting lip on a portion thereof and is selectively rotatable between an unlocked position in which the sweep cam is entirely received in the cam housing recess and a locked position in which the portion of the sweep cam having the upwardly projecting lip extends outward through the opening. A handle is operably coupled to the sweep cam to enable the sweep cam to be selectively rotated between the unlocked and the locked positions. A keeper has a base portion with a forwardly projecting barrier, and a top portion with a rear wall, a pair of side walls, a top wall and a front wall together defining a recess. The front wall defines a forwardly facing opening to receive a portion of the sweep cam in the recess. A boss projects downwardly from the top wall into the forwardly facing opening, wherein when the opening of the housing is registered with the forwardly facing opening of the keeper, and the sweep cam is rotated to engage behind the boss of the keeper, the barrier of the housing engages and extends over the barrier of the keeper.

In an embodiment, the housing further comprises a rearwardly extending shroud, the shroud extending over and substantially enclosing the keeper when the opening of the housing is registered with the forwardly facing opening of the keeper.

In an embodiment, the housing further comprises a pair of wings extending laterally on opposite sides of the housing, each of the wings defining an aperture for receiving a fastener to fasten the housing to the sash of a window.

In an embodiment, the base portion of the keeper defines a pair of apertures for receiving fasteners to fasten the keeper to the sash of a window.

A further embodiment includes a window system having a frame, a lower sash slidably received in the frame, and an upper sash slidably received in the frame. The window system includes a lock assembly for locking the lower sash to the upper sash, the lock assembly including a sweep cam, a housing fastened to an upper rail of the lower sash and having a front wall, a pair of side walls, a top wall, and a rear wall together defining a cam housing recess. The sweep cam is rotatably received in the cam housing recess. The rear wall of the housing defines an opening, and a barrier portion extends rearwardly from the rear wall under the opening. The sweep cam presents an upwardly projecting lip on a portion thereof and is selectively rotatable between an unlocked position in which the sweep cam is entirely received in the cam housing recess and a locked position in which the portion of the sweep cam having the upwardly projecting lip extends outward through the opening. A handle is operably coupled to the sweep cam to enable the sweep cam to be selectively rotated between the unlocked and the locked positions. A keeper is fastened to a lower rail of the upper sash and has a base portion with a forwardly projecting barrier, and a top portion with a rear wall, a pair of side walls, a top wall and a front wall together defining a recess. The front wall defines a forwardly facing opening to receive a portion of the sweep cam in the recess. A boss projects downwardly from the top wall into the forwardly facing opening, wherein when the opening of the housing is registered with the forwardly facing opening of the keeper, and the sweep cam is rotated to engage behind the boss of the keeper, the upper rail of the lower sash and the lower rail of the upper sash of the window are shifted closer together and the barrier of the housing engages and extends over the barrier of the keeper.

In an embodiment, the housing further comprises a rearwardly extending shroud, the shroud extending over and substantially enclosing the keeper when the opening of the housing is registered with the forwardly facing opening of the keeper.

In an embodiment, the housing further comprises a pair of wings extending laterally on opposite sides of the housing, each of the wings defining an aperture for receiving a fastener to fasten the housing to the lower sash of the window.

In an embodiment, the base portion of the keeper defines a pair of apertures for receiving fasteners to fasten the keeper to the upper sash of the window.

In a further embodiment, a lock assembly for a sliding window includes a sweep cam, a housing having a front wall, a pair of side walls, a top wall, and a rear wall together defining a cam housing recess. The sweep cam is rotatably received in the cam housing recess. The rear wall defines an opening, and a barrier portion extends rearwardly from the rear wall under the opening. The sweep cam is selectively rotatable between an unlocked position in which the sweep cam is entirely received in the cam housing recess and a locked position in which a portion of the sweep cam extends outward through the opening. The lock assembly further includes a handle operably coupled to the sweep cam to enable the sweep cam to be selectively rotated between the unlocked and the locked positions, and a keeper having a base portion with a forwardly projecting barrier, a top portion with a rear wall, a pair of side walls, a top wall and a front wall together defining a recess. The front wall defines a forwardly facing opening to receive a portion of the sweep cam in the recess, wherein when the opening of the housing is registered with the forwardly facing opening of the keeper, and the sweep cam is rotated to the locked position, the barrier of the housing engages and extends over the barrier of the keeper.

BRIEF DESCRIPTION OF THE DRAWINGS

The embodiments of the present invention may be more completely understood in consideration of the following detailed description of various embodiments in connection with the accompanying drawings, in which.

Figure 1:
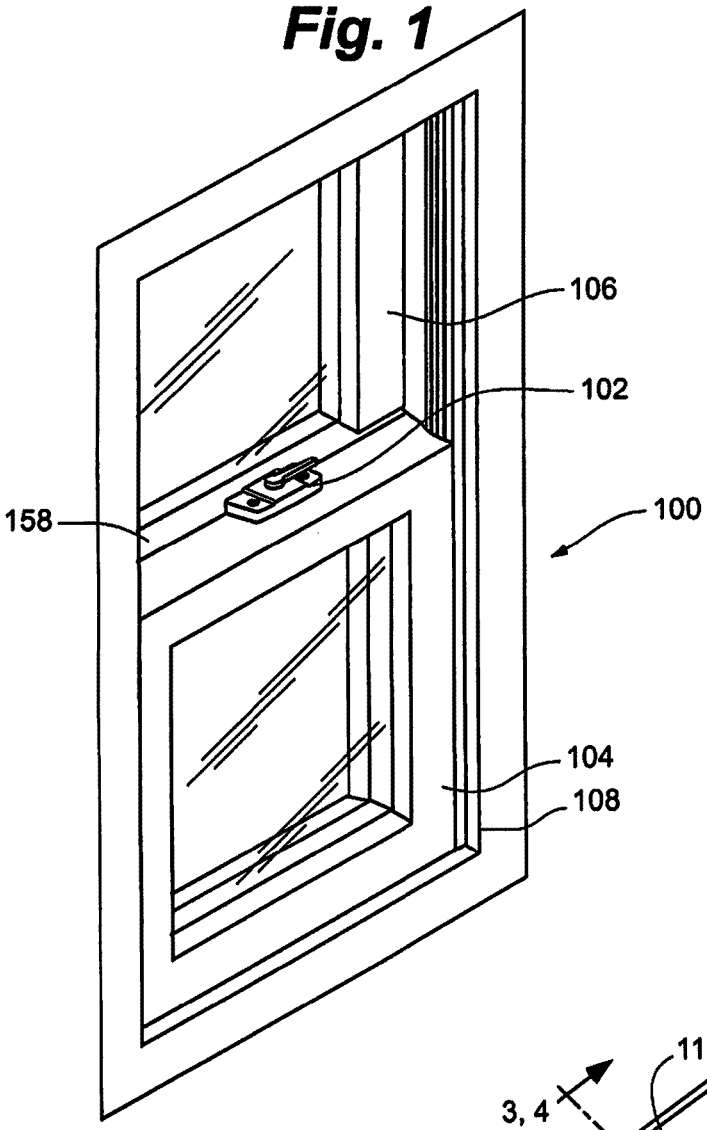
FIG. 1 is an isometric view of a double-hung sliding window according to an embodiment of the invention.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

In FIGS. 1-7 there is depicted a double-hung sliding window 100 with a lock assembly 102 according to an embodiment of the invention. Window 100 generally includes lower sash 104 and upper sash 106 slidably disposed in frame 108 as is generally known in the art.

Figure 6:
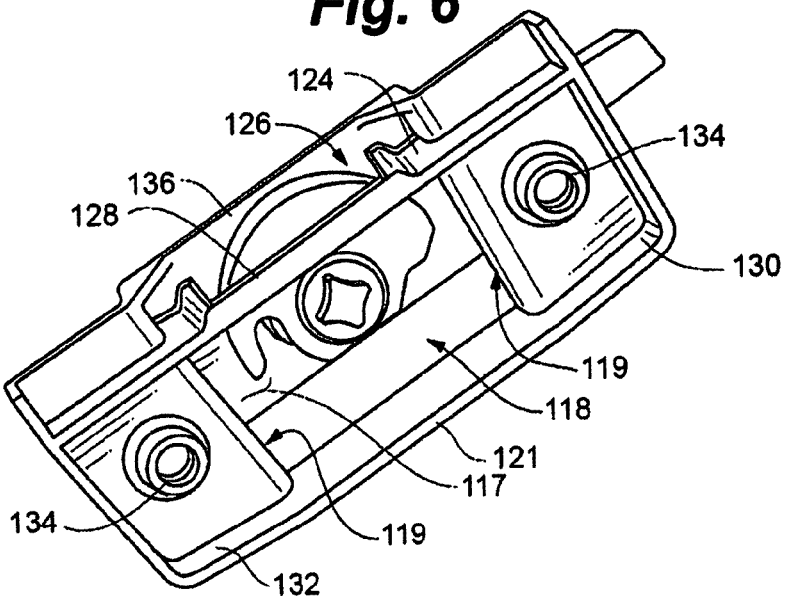
FIG. 6 is a bottom isometric view of the housing of the lock assembly depicted in FIG. 2.

Lock assembly 102 generally includes housing 110, rotatable sweep cam 112, handle 114, and keeper 116. Sweep cam 112 is rotatably mounted in housing 110, and is selectively rotatable with handle 114. Housing 110, as depicted in FIGS. 3-6, may be formed in one-piece, and generally includes top wall 117, side walls 119, and front wall 121, defining cam recess 118 in which sweep cam 112 is received. Rear wall 124 defines opening 126 through which sweep cam 112 extends in the locked position. Barrier 128 extends under opening 126, and protrudes rearwardly from rear wall 124 as depicted in FIG. 6. Wings 130, 132, extend laterally from the portion of housing 110 defining cam recess 118, and define apertures 134 for receiving fasteners to attach housing 110 to lower sash 104. Shroud 136 protrudes rearwardly over opening 126 and also extends rearwardly from wings 130, 132.

Figure 7:
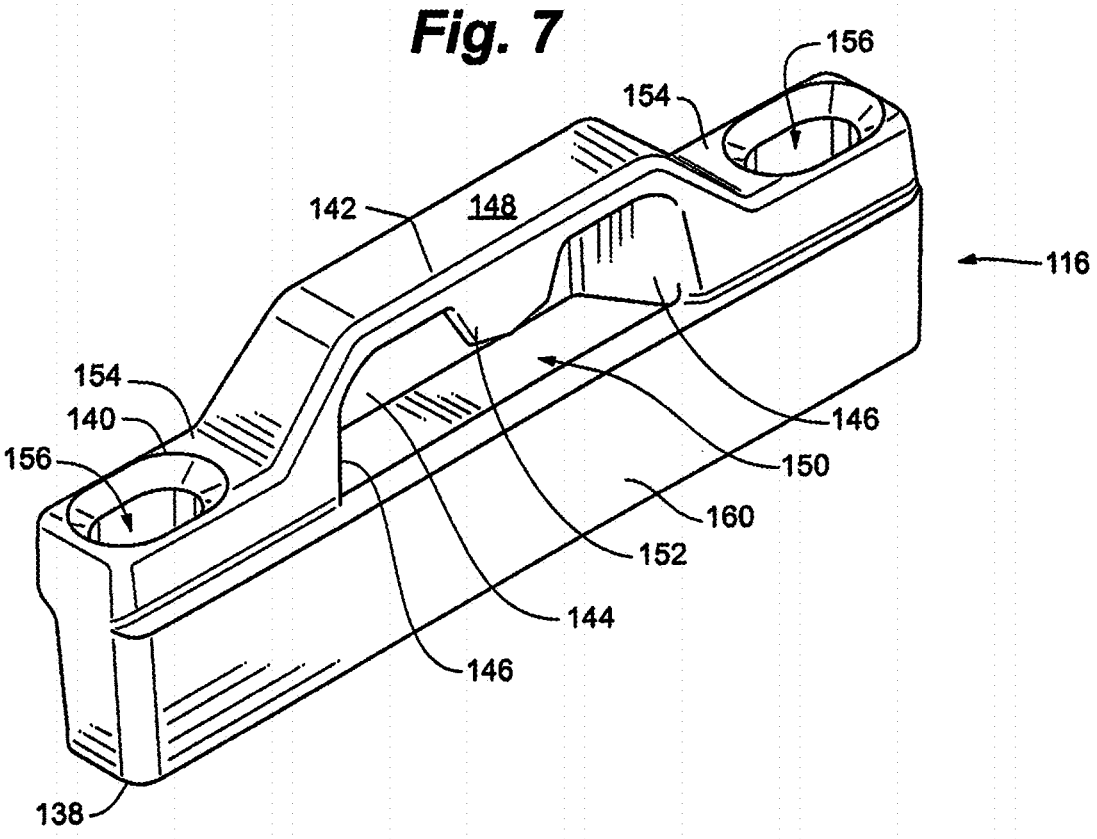
FIG. 7 is an isometric view of the keeper of the lock assembly of FIG. 2.

As depicted in FIG. 7, keeper 116 generally includes base portion 138 and upper portion 140. Upper portion 140 includes raised housing 142 defined by back wall 144, side walls 146 and top wall 148. Cam opening 150 is defined in the front side of raised housing 142. Boss 152 extends downwardly from top wall 148. Securing portions 154 extend laterally outward from raised housing 142, and define apertures 156 for receiving fasteners (not depicted) to secure keeper 116 to lower rail 158 of upper sash 106. As depicted in FIG. 7, base portion 138 protrudes slightly in the forward direction relative to upper portion 140, thereby defining barrier 160.

Figure 2:
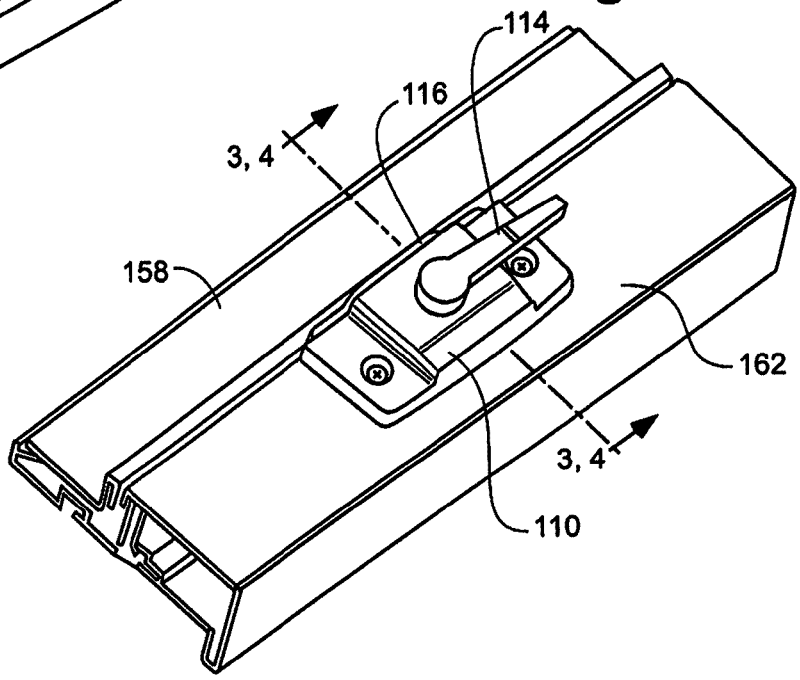
FIG. 2 is a partial isometric view of the lock assembly of the window of FIG. 1.
Figure 3:
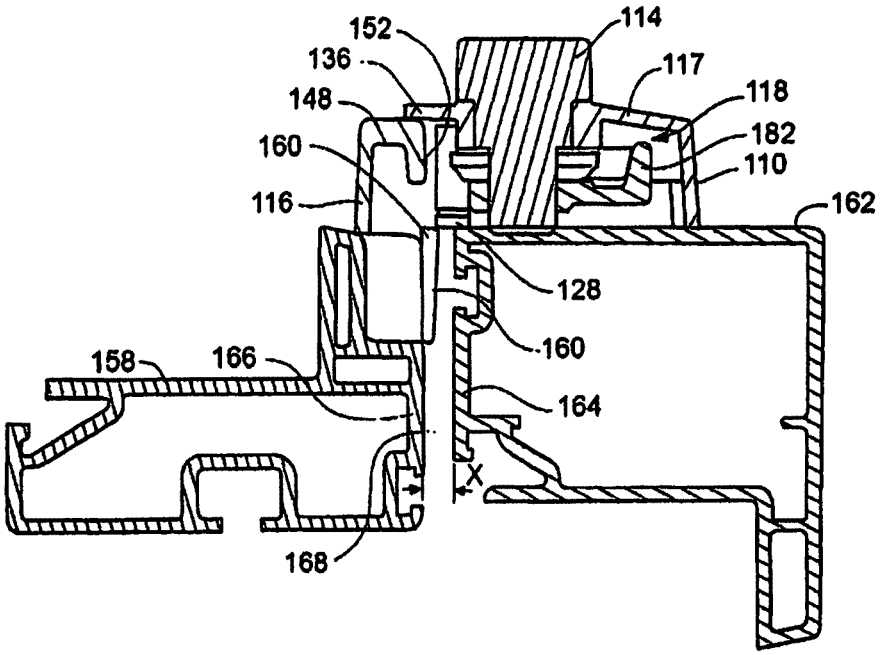
FIG. 3 is a section view taken at section 3-3 of FIG. 2, with the lock assembly in an unlocked condition.

In use, housing 110 is mounted to upper rail 162 of lower sash 104 and keeper 116 is mounted to lower rail 158 of upper sash 106 as depicted in FIGS. 1-4. As depicted in FIG. 2, keeper 116 is almost entirely covered by shroud 136 with window 100 in the closed position. In the unlocked position as depicted in FIG. 3, wherein sweep cam 112 is fully received in cam recess 118, barrier 128 protrudes rearwardly, proximate or slightly over barrier 160 of keeper 116. Upper portion 140 of keeper 116 is set back sufficiently to enable lower sash 104 to be shifted upward to open window 100 without barrier 128 striking any portion of keeper 116. Shroud 136 extends rearwardly over top wall 148 of keeper 116, and also over securing portions 154. In this unlocked condition, rear wall 164 of upper rail 162 and front wall 166 of lower rail 152 define gap 168 with distance X between the sashes.

As depicted in FIG. 3, when handle 114 is rotated to engage upper lip 162 sweep cam 112 behind boss 152 of keeper 116, thereby locking lower sash 104 with upper sash 106, lower sash 104 and upper sash 106 are shifted slightly toward each other by the action of sweep cam 112, thereby narrowing gap 168 to a distance $X_1$, which is less than distance X. In this position, barrier 128 protrudes into cam opening 150, extends over, and engages with barrier 160 of keeper 116. Shroud 136 is shifted rearwardly so as to cover more of keeper 116 relative to the unlocked position of FIG. 3.

Figure 4:
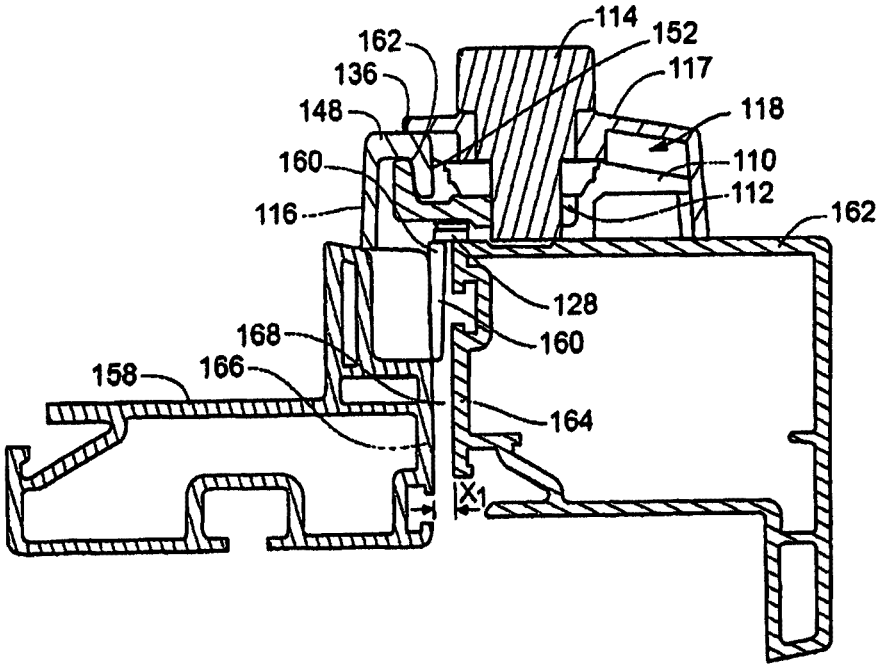
FIG. 4 is a section view taken at section 4-4 of FIG. 2, with the lock assembly in a locked condition.
Figure 5:
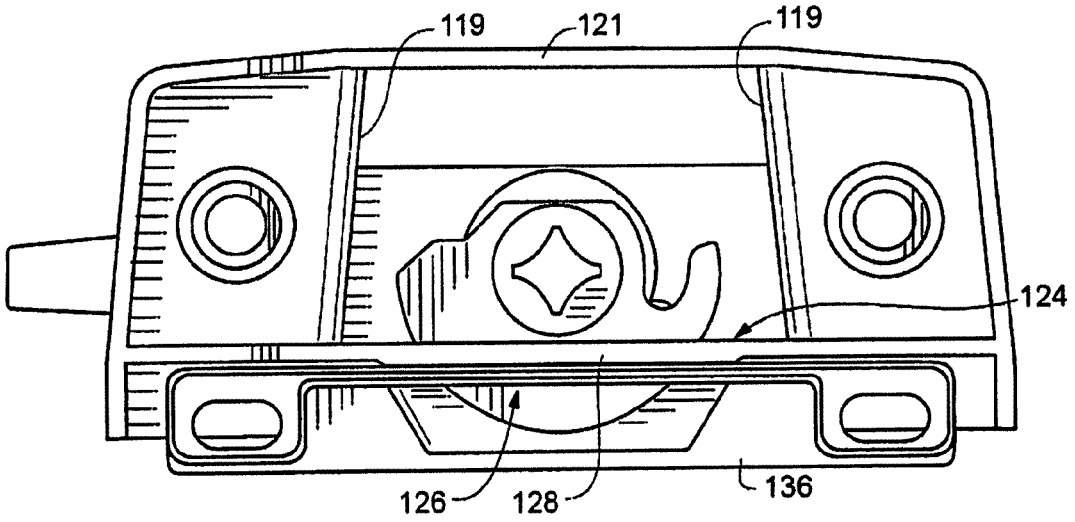
FIG. 5 is a bottom plan view of the lock assembly and keeper depicted in FIG. 2.

As such, particularly with lock assembly 102 in the locked condition as depicted in FIG. 4, barrier 160 and barrier 128 inhibit any attempt to insert a tool through gap 168 and thereby rotate or dislodge sweep cam 112 from engagement with keeper 116. Shroud 136 substantially covers keeper 116 and inhibits attempts to access and dislodge sweep cam 112 from the sides or to manipulate handle 114 with a tool inserted through gap 168.

The foregoing descriptions present numerous specific details that provide a thorough understanding of various embodiments of the invention. It will be apparent to one skilled in the art that various embodiments, having been disclosed herein, may be practiced without some or all of these specific details. In other instances, components as are known to those of ordinary skill in the art have not been described in detail herein in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments may be constructed that nevertheless employ the principles and spirit of the present invention. Accordingly, this application is intended to cover any adaptations or variations of the invention.

For purposes of interpreting the claims for the present invention, it is expressly intended that the provisions of 35 U.S.C. §112(f) are not to be invoked unless the specific terms "means for" or "step for" are recited in a claim.

What is claimed is:

1. A lock assembly for a sliding window comprising:

a sweep cam;

a housing having a front wall, a pair of side walls, a top wall, and a rear wall together defining a cam housing recess, the sweep cam rotatably received in the cam housing recess, the rear wall defining an opening, and a barrier portion extending rearwardly from the rear wall under the opening, the sweep cam selectively rotatable between an unlocked position in which the sweep cam is entirely received in the cam housing recess and a locked position in which a portion of the sweep cam extends outward through the opening;

a handle operably coupled to the sweep cam to enable the sweep cam to be selectively rotated between the unlocked and the locked positions; and a keeper having a base portion with a forwardly projecting barrier, and a top portion with a rear wall, a pair of side walls, a top wall and a front wall together defining a recess, the front wall defining a forwardly facing opening to receive a portion of the sweep cam in the recess, wherein when the opening of the housing is registered with the forwardly facing opening of the keeper, and the sweep cam is rotated to the locked position, the barrier portion of the housing engages and extends over the barrier of the keeper.

2. The lock assembly of claim 1, wherein the housing further comprises a pair of wings extending laterally on opposite sides of the housing, each of the wings defining an aperture for receiving a fastener to fasten the housing to a sash of the sliding window.

3. The lock assembly of claim 1, wherein the base portion of the keeper defines a pair of apertures for receiving fasteners to fasten the keeper to a sash of the sliding window.

4. The lock assembly of claim 1, wherein the sweep cam presents an upwardly projecting lip on a portion thereof, and the keeper has a boss extending downwardly from the top wall of the keeper.

5. The lock assembly of claim 4, wherein as the sweep can is rotated to the locked position, the upwardly projecting lip engages behind the boss of the keeper and the housing and the keeper are shifted closer together.

* * * * *